US009784151B2

(12) United States Patent
Metcalf et al.

(10) Patent No.: US 9,784,151 B2
(45) Date of Patent: Oct. 10, 2017

(54) SPRAY COOLED OIL SYSTEM FOR AN INTERNAL COMBUSTION ENGINE

(71) Applicant: Briggs & Stratton Corporation, Wauwatosa, WI (US)

(72) Inventors: Bryce Metcalf, New Berlin, WI (US); Randy Ammentorp, Menomonee Falls, WI (US)

(73) Assignee: Briggs & Stratton Corporation, Wauwatosa, WI (US)

( * ) Notice: Subject to any disclaimer, the term of this patent is extended or adjusted under 35 U.S.C. 154(b) by 111 days.

(21) Appl. No.: 14/174,604

(22) Filed: Feb. 6, 2014

(65) Prior Publication Data

US 2014/0216371 A1 Aug. 7, 2014

Related U.S. Application Data

(60) Provisional application No. 61/761,458, filed on Feb. 6, 2013.

(51) Int. Cl.
*F01M 1/04* (2006.01)
*F01M 1/02* (2006.01)
(Continued)

(52) U.S. Cl.
CPC ..... *F01M 13/00* (2013.01); *F01M 1/04* (2013.01); *F01M 1/08* (2013.01); *F01M 1/16* (2013.01);
(Continued)

(58) Field of Classification Search
CPC . F01M 1/04; F01M 1/16; F01M 11/02; F01M 1/02; F01M 13/00; F01M 1/08;
(Continued)

(56) References Cited

U.S. PATENT DOCUMENTS 1,151,258 A * 8/1915 Fischer ..... F02M 61/1853 239/596
2,800,119 A * 7/1957 Schmidl ..... F01M 1/08 123/41.35
(Continued)

FOREIGN PATENT DOCUMENTS

DE 000004344228 * 6/1995
EP 2541004 1/2013
WO WO2005/003523 * 1/2005

OTHER PUBLICATIONS

Piston Cooling Jet Operation as viewed at http://www.youtube.com/watch?v=uMnFbsy0Hgg.

*Primary Examiner* — Syed O Hasan
(74) *Attorney, Agent, or Firm* — Michael Best & Friedrich LLP

(57) ABSTRACT

An engine includes a crankcase defining a crankcase space, a first shaft disposed at least partially within the crankcase and supported for rotation by the crankcase, and an oil pump coupled to the first shaft and operable to draw low pressure oil from the crankcase and discharge a flow of high pressure oil. A pressure relief path is positioned to selectively receive a portion of the flow of high pressure oil and a pressure relief assembly is coupled to the pressure relief path and is arranged to spray the portion of the high pressure flow that passes through the pressure relief passage against an interior surface of the crankcase.

19 Claims, 5 Drawing Sheets

(51) Int. Cl.

| | |
|---|---|
| ***F01M 13/00*** | (2006.01) |
| ***F01M 1/08*** | (2006.01) |
| ***F01M 1/16*** | (2006.01) |
| ***F02F 7/00*** | (2006.01) |
| *F01M 1/06* | (2006.01) |

(52) U.S. Cl.
CPC ..... *F02F 7/0012* (2013.01); *F01M 2001/064* (2013.01)

(58) Field of Classification Search
CPC ..... F01M 2001/064; F02B 2075/027; F01L 1/46; F02F 7/0012
USPC ..... 123/41.31, 41.69, 196 R, 196 CP
See application file for complete search history.

(56) References Cited

U.S. PATENT DOCUMENTS

| | | | | |
|---|---|---|---|---|
| 4,475,488 | A * | 10/1984 | Odashima | F01M 1/02 123/196 CP |
| 6,257,178 | B1 * | 7/2001 | Laimbock | B62K 11/04 123/54.1 |
| 2011/0162613 | A1 * | 7/2011 | Schiffer | F01M 1/12 123/196 R |

* cited by examiner

SPRAY COOLED OIL SYSTEM FOR AN INTERNAL COMBUSTION ENGINE

RELATED APPLICATION DATA

This application claims priority to U.S. Provisional Application No. 61/761,458 filed Feb. 6, 2013, the entire contents of which are incorporated herein by reference.

BACKGROUND

Some current engines run hotter than desired per application heat test specification. The oil pump size for these engines is large relative to displacement and bypasses significant volumes of oil during normal operation. The large oil pump size is an advantage in terms of providing sufficient oil to the engine components when the engine oil is hot and the engine is operating at a low speed. The large pump also compensates for bearing wear over time and compensates for larger bearing clearance tolerance stack-up that may exist in some engines.

SUMMARY

In one construction, the invention provides an engine that includes a crankcase defining a crankcase space, a first shaft disposed at least partially within the crankcase and supported for rotation by the crankcase, and an oil pump coupled to the first shaft and operable to draw low pressure oil from the crankcase and discharge a flow of high pressure oil. A pressure relief path is positioned to selectively receive a portion of the flow of high pressure oil and a pressure relief assembly is coupled to the pressure relief path and is arranged to spray the portion of the high pressure flow that passes through the pressure relief passage against an interior surface of the crankcase.

In another construction, the invention provides an engine that includes a crankcase having a first end, a second end, and a crankcase space. A first cylinder is coupled to the first end and first piston is operable to reciprocate within the crankcase. A crankshaft is rotatable in response to reciprocation of the first piston, a camshaft is rotatable in response to rotation of the crankshaft, and an oil pump is operable in response to the rotation of the camshaft to draw low pressure oil from the crankcase space and deliver a flow of high pressure oil. A pressure relief path is positioned to selectively receive a portion of the flow of high pressure oil and a pressure relief assembly is coupled to the pressure relief path and is arranged to spray the portion of the high pressure flow that passes through the pressure relief passage against the second end of the crankcase.

In yet another construction, the invention provides a method of cooling an engine lubricant within an engine. The method includes reciprocating a piston within a cylinder, drawing low pressure oil from a crankcase space into an oil pump in response to the reciprocating piston, and discharging a flow of high pressure oil from the oil pump. The method also includes selectively directing a portion of the high pressure oil to a pressure relief path and discharging the portion of high pressure oil through a nozzle, the nozzle operable to reduce the pressure of the high pressure oil and to spray the oil onto a surface of a crankcase.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 4:
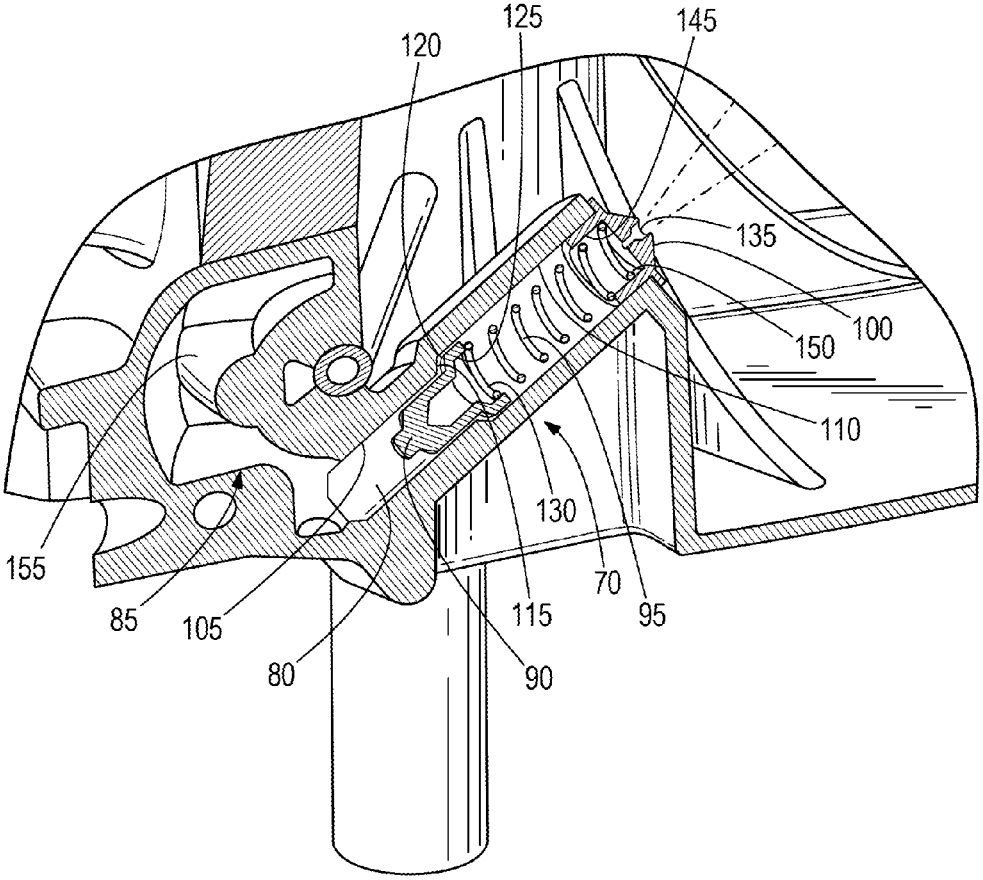
FIG. 4 is an enlarged perspective view of a portion of the engine of FIG. 3.
Figure 5:
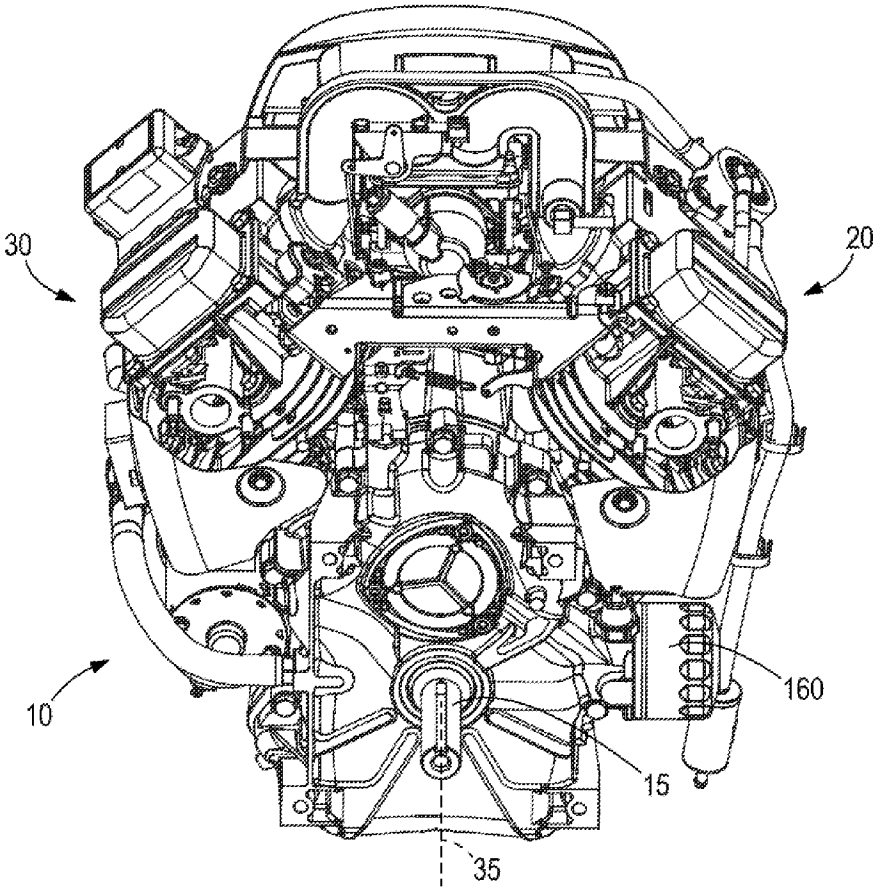
FIG. 5 is a front view of a prior art engine.

FIG. 5 illustrates an engine 10 including a crankcase 15 having a first side 20 and a second side 25 that is substantially opposite the first side 20. A first cylinder 30 extends from the first side 20 at an oblique angle with respect to a vertical axis 35 (vertical in FIG. 4) and a second cylinder 40 extends from the first side 20 at an opposite oblique angle. Thus, the cylinders 30, 40 define a V-shaped or V-twin arrangement with the vertical axis 35 bisecting the "V". A first piston 45 is disposed within the first cylinder 30 to define a first piston-cylinder and a second piston (not shown) is disposed within the second cylinder 40 to define a second piston-cylinder. A crankshaft 50 extends from the crankcase 15 and is coupled to the first piston 45 and the second piston as is known in the art.

Each of the cylinders 30, 40 includes a plurality of exterior fins 55 that aid in cooling during engine operation. As is known to those of skill in the art, the cylinders 30, 40 are the hottest point of the engine 10 with the second side 40 of the crankcase 15 being substantially cooler during engine operation. In the illustrated construction, the cylinders 30, 40 are formed as part of the crankcase 15. However, other constructions may include separate cylinders 30, 40 that attach to the crankcase 15.

Figure 3:
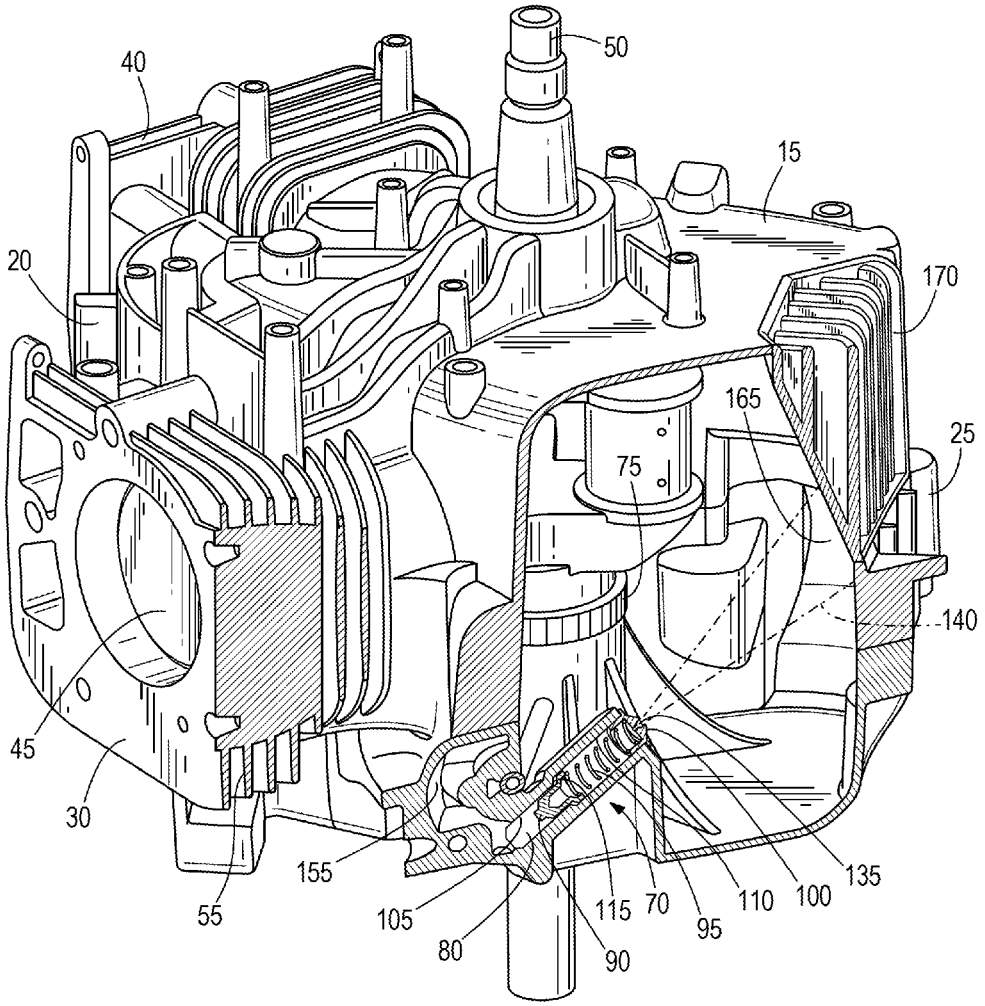
FIG. 3 is another isometric sectional view of the spray cool oil system in accordance with an exemplary embodiment.

Turning to FIG. 3, a portion of the engine 10 is illustrated with a portion of the crankcase 15 broken away to better illustrate the interior. As can be seen, the engine 10 further includes a camshaft 60, an oil pump 65 and a pressure relief assembly 70. The camshaft 60 is disposed parallel to the crankshaft 50 with the crankcase 15 supporting both for rotation. Gears 75 on the camshaft 60 and the crankshaft 50 mesh to produce rotation of the camshaft 60 at a desired speed with respect to the crankshaft 50. For example, a ratio of two to one with the camshaft 60 rotating once for every two revolutions of the crankshaft 50 is common. Cams 80 are coupled to the camshaft 60 and are arranged to operate the various intake and exhaust valves of the piston-cylinders. In the illustrated construction, four cams 80 are provided with each cam 80 operating either an intake valve or an exhaust valve for one of the piston-cylinders.

The oil pump 65 is disposed at one end of the camshaft 60 and is supported for rotation with the camshaft 60. In the illustrated construction, a rotary gear pump is employed as the pump 65. In preferred constructions, the oil pump 65 is positioned at or near the lowest operating point of the engine 10 to reduce the length of suction required to draw low pressure oil into the pump 65. However, other arrangements are possible. In the illustrated construction, the engine 10 is arranged with the crankshaft 50 in a vertical orientation and the oil pump 65 at the bottom of the crankcase 15.

The pressure relief assembly 70, best illustrated in FIG. 4 includes a pressure relief path 85, a plug 90, a biasing member 95, and a nozzle 100. The pressure relief path 85 includes a first diameter portion 105 and a second larger diameter portion 110 downstream of the first diameter portion 105. The interface between the first diameter portion 105 and the second diameter portion 110 defines a plug seat 115 that is arranged to receive the plug 90 and define a seal therebetween. The plug seat 115 may be tapered, rounded, or otherwise formed to enhance the seal between the plug 90 and the plug seat 115 as may be desired.

The plug 90 includes a tapered outer surface 120 that is arranged to engage the plug seat 115 to form a seal between the plug seat 115 and the plug 90, thereby inhibiting the unwanted passage of oil. The plug 90 also includes an inner surface 125 that is sized and arranged to receive a first end 130 of the biasing member 95.

The nozzle 100 is sized to fixedly engage the second diameter portion 110 to substantially close the end opposite the plug seat 115. One or more apertures 135 are formed in the nozzle 100 to produce the desired pressure drop and spray pattern 140 during operation, as will be discussed below. The nozzle 100 includes an inner surface 145 arranged to receive and support a second end 150 of the biasing member 95.

The biasing member 95 is positioned between the plug 90 and the nozzle 100 and acts to bias the plug 90 into sealed engagement with the plug seat 115. In the illustrated construction, the biasing member 95 includes a coil spring with other biasing members 95 or arrangements being possible. The biasing member 95 is selected to maintain the plug 90 in the closed position until the pressure of the oil against the plug 90 exceeds a predetermined value. When the oil pressure is above the predetermined value, the plug 90 moves to an open position and high pressure oil flows to the nozzle 100 and out the nozzle aperture 135.

During engine operation, combustion of a fuel occurs within the piston-cylinders as is known in the art. The combustion produces reciprocating movement of the piston 45 which is converted to rotation of the crankshaft 50 and the camshaft 60 as is known in the art. Rotation of the camshaft 60 rotates the oil pump 65. As the oil pump 65 rotates, low pressure oil is drawn into the oil pump 65 and then discharged at a high pressure (between about 20 psi and 100 psi). The high pressure oil flows along a flow path 155 to an oil filter 160 (shown in FIG. 4). The pressure relief path 85 is connected to the flow path 155 at a point between the oil pump 65 and the filter 160.

When the engine 10 is operating at lower power levels or speeds, the oil pump 65 produces oil at a pressure low enough to assure that the pressure relief assembly 70 remains in a closed position. At some operating conditions, such as high speed operation or high power output operation, the pressure of the oil discharged by the oil pump 65 may exceed a predetermined pressure level. When this occurs, the oil pressure overcomes the force applied to the plug 90 by the biasing member 95 and the plug 90 moves toward an open position. When opened, a portion of the high pressure oil flows through the pressure relief path 85 and through the nozzle 100.

Figure 1:
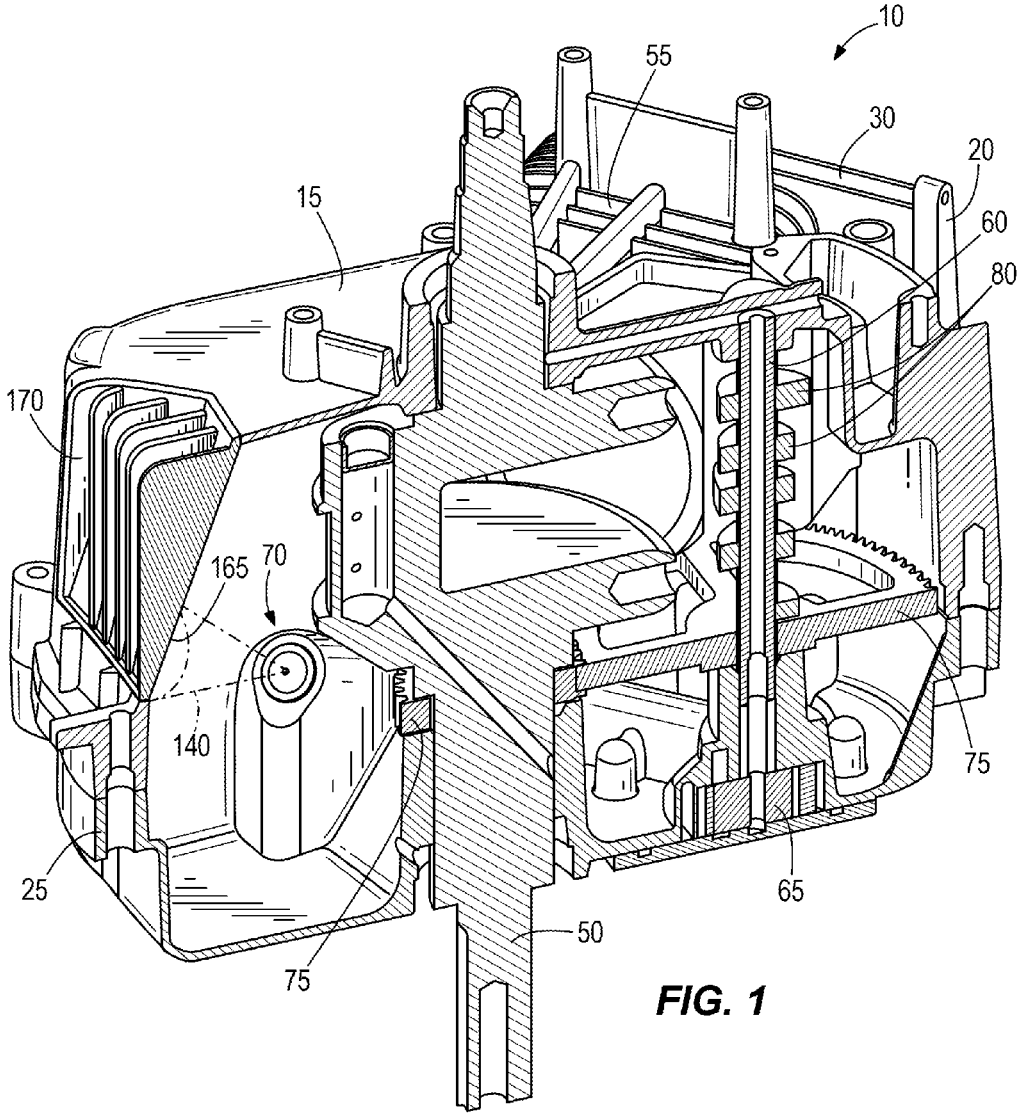
FIG. 1 is an isometric sectional view of the spray cool oil system in accordance with an exemplary embodiment.
Figure 2:
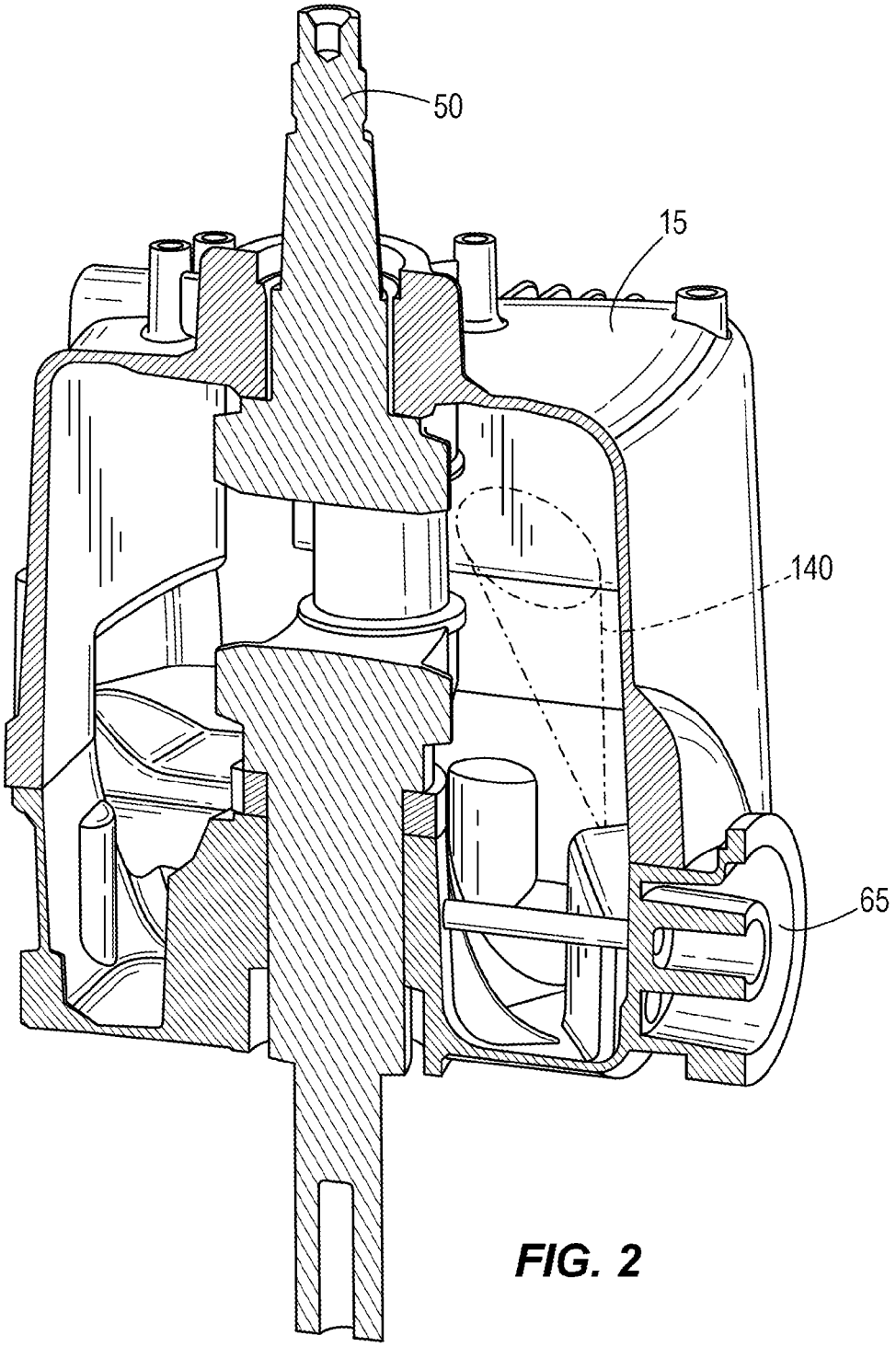
FIG. 2 is another isometric sectional view of the spray cool oil system in accordance with an exemplary embodiment.

As illustrated in each of FIGS. 1-3, the nozzle 100 is arranged to discharge the oil in a fanned pattern 140 that impinges against a wall 165 of the crankcase 15. The wall 165 is selected to aid in the cooling of the oil as it is the wall 165 opposite the cylinders 30, 40 and therefore naturally operates at a temperature that is relatively cool when compared to the opposite end (cylinder or first end 20) of the crankcase 15. Fins 170 are formed on the exterior of the crankcase 15 adjacent this wall 165 to further aid in cooling the area, thereby further cooling the oil within the crankcase 15. The nozzle 100 also throttles the oil to a pressure that is about equal to the pressure within the crankcase (atmospheric pressure or lower), thereby cooling the oil.

Thus, the nozzle 100 sprays the hot bypassed oil against the relatively cool wall 165 of the second side 25 of the crankcase 15. The oil will be cooled in several ways. Initially, the pressure drop as the oil escapes the pressure relief path 85 and moves into the internal atmospheric pressure of the crankcase 15 will produce a cooling effect for the oil. Next, forced convection between the oil as it is sprayed and the internal atmosphere of the crankcase 15 further cools the hot oil. The wider fanned pattern 140 enhances this cooling effect. Next, the hot oil directly contacts the inner surface of the crankcase 15 and conduction directs heat from the oil to the cooler wall 165 of the crankcase 15. Finally, the fanned spray pattern 140 is such that the surface area of the crankcase 15 impacted by the oil and through which the oil is cooled is much larger than the area employed in internal pump bypass designs, thereby further enhancing the cooling efficiency.

In some constructions, cooling air can be directed from the engine blower or fan to the external fins 170 to further enhance the cooling efficiency of the system.

Various features and advantages of the invention are set forth in the following claims.

We claim:

1. An engine comprising: a crankcase defining a crankcase space; a first shaft disposed at least partially within the crankcase and supported for rotation by the crankcase; an oil pump coupled to the first shaft and operable to draw low pressure oil from the crankcase and discharge a flow of high pressure oil; a pressure relief path positioned to selectively receive a portion of the flow of high pressure oil; and a pressure relief assembly coupled to the pressure relief path and including a nozzle arranged to spray the portion of the high pressure flow that passes through the pressure relief path in a fan pattern directly and non-tangentially against an interior surface of the crankcase in order to cool the portion of the high pressure flow that passes through the pressure relief path, wherein the pressure relief assembly is movable between a closed position when a pressure of the flow of high pressure oil is below a predetermined non-zero pressure and an open position when the pressure is above the predetermined non-zero pressure.

2. The engine of claim 1, further comprising a first cylinder coupled to a first end of the crankcase and a first piston reciprocating within the cylinder.

3. The engine of claim 2, further comprising a second cylinder coupled to a first end of the crankcase and a second piston reciprocating within the cylinder.

4. The engine of claim 2, further comprising a second shaft coupled to the first piston and rotatable in response to reciprocation of the first piston, and wherein the first shaft rotates in response to rotation of the second shaft.

5. The engine of claim 2, further comprising a plurality of cooling fins coupled to an exterior of the crankcase adjacent the interior surface of the crankcase where the pressure relief assembly sprays the portion of the high pressure flow.

6. The engine of claim 5, wherein the plurality of cooling fins are positioned on a second end of the crankcase substantially opposite the first end.

7. The engine of claim 1, further comprising an oil filter positioned in a flow path to receive the flow of high pressure oil, and wherein the pressure relief path is coupled to the flow path between the oil pump and the filter.

8. The engine of claim 1, wherein the high pressure oil is discharged from the pump at a pressure between about 20 psi and 100 psi and wherein the pressure relief assembly is operable to reduce the oil pressure from the high pressure level to a low pressure level that is at or below atmospheric pressure.

9. The engine of claim 1, wherein the pressure relief assembly includes a plug movable between a closed position and an open position, a nozzle, and a biasing member that biases the plug toward the closed position.

10. An engine comprising: a crankcase having a first end, a second end, and a crankcase space; a first cylinder coupled to the first end; a first piston operable to reciprocate within the crankcase; a crankshaft rotatable in response to reciprocation of the first piston; a camshaft rotatable in response to rotation of the crankshaft; an oil pump operable in response to the rotation of the camshaft to draw low pressure oil from the crankcase space and deliver a flow of high pressure oil; a pressure relief path positioned to selectively receive a portion of the flow of high pressure oil; and a pressure relief assembly movable from a closed position to an open position in response to a pressure of the high pressure oil exceeding a predetermined value, the pressure relief assembly coupled to the pressure relief path and including a nozzle arranged to spray the portion of the high pressure flow that passes through the pressure relief path in a fan pattern directly and non-tangentially against the second end of the crankcase to cool the oil when the pressure relief assembly is in the open position and to not spray any oil when the pressure relief assembly is in the closed position.

11. The engine of claim 10, further comprising a second cylinder coupled to a first end of the crankcase and a second piston reciprocating within the cylinder, and wherein the first cylinder and the second cylinder are arranged in a V-shape and the second end of the crankcase is substantially opposite the first end.

12. The engine of claim 10, further comprising a plurality of cooling fins coupled to an exterior of the second end of the crankcase.

13. The engine of claim 10, further comprising an oil filter positioned in a flow path to receive the flow of high pressure oil, and wherein the pressure relief path is coupled to the flow path between the oil pump and the filter.

14. The engine of claim 10, wherein the high pressure oil is discharged from the pump at a pressure between about 20 psi and 100 psi and wherein the pressure relief assembly is operable to reduce the oil pressure from the high pressure level to a low pressure level that is at or below atmospheric pressure.

15. The engine of claim 10, wherein the pressure relief assembly includes a plug movable between the closed position and the open position, a nozzle, and a biasing member that biases the plug toward the closed position.

16. The engine of claim 15, wherein the nozzle includes an aperture arranged to discharge the oil in a fanned pattern.

17. A method of cooling an engine lubricant within an engine, the method comprising: reciprocating a piston within a cylinder; drawing low pressure oil from a crankcase space into an oil pump in response to the reciprocating piston; discharging a flow of high pressure oil from the oil pump; selectively directing a portion of the high pressure oil to a pressure relief path; and discharging the portion of high pressure oil through a nozzle, the nozzle operable to reduce the pressure of the high pressure oil and to spray the oil in a fan pattern directly and non-tangentially onto a surface of a crankcase to cool the oil.

18. The method of claim 17, further comprising coupling a plurality of fins to an external surface of the crankcase substantially opposite the cylinder to further cool the crankcase and the oils sprayed on the surface of the crankcase.

19. The method of claim 17, wherein the discharging the portion of high pressure oil through a nozzle step includes reducing the pressure of the high pressure oil from between about 20 psi and 100 psi to a low pressure level that is at or below atmospheric pressure.

* * * * *